US008093980B2

(12) United States Patent
Asou et al.

(10) Patent No.: US 8,093,980 B2
(45) Date of Patent: Jan. 10, 2012

(54) SURFACE MOUNT PULSE TRANSFORMER AND METHOD AND APPARATUS FOR MANUFACTURING THE SAME

(75) Inventors: Hirohumi Asou, Tokyo (JP); Mitsutaka Yasuda, Tokyo (JP); Satoru Sariishi, Tokyo (JP); Satoru Kitahara, Tokyo (JP)

(73) Assignee: TDK Corporation, Tokyo (JP)

( * ) Notice: Subject to any disclaimer, the term of this patent is extended or adjusted under 35 U.S.C. 154(b) by 162 days.

(21) Appl. No.: 12/607,993

(22) Filed: Oct. 29, 2009

(65) Prior Publication Data

US 2010/0109827 A1 May 6, 2010

(30) Foreign Application Priority Data

Oct. 31, 2008 (JP) ..... 2008-281761

(51) Int. Cl.

| | |
|---|---|
| ***H01F 27/29*** | (2006.01) |
| ***H01F 27/02*** | (2006.01) |
| ***H01F 27/28*** | (2006.01) |
| ***H01F 17/04*** | (2006.01) |

(52) U.S. Cl. ..... 336/192; 336/83; 336/220; 336/221; 336/222; 336/225

(58) Field of Classification Search ..... 336/83, 336/192, 220–222, 225
See application file for complete search history.

(56) References Cited

FOREIGN PATENT DOCUMENTS

| | | |
|---|---|---|
| JP | H01-309312 | 12/1989 |
| JP | H07-099122 | 4/1995 |
| JP | H07-135117 | 5/1995 |
| JP | H07-161535 | 6/1995 |
| JP | 2002-289453 | 10/2002 |
| JP | 2008-186996 | 8/2008 |

*Primary Examiner* — Anh Mai
*Assistant Examiner* — Ronald Hinson
(74) *Attorney, Agent, or Firm* — Young Law Firm, P.C.

(57) ABSTRACT

A surface mount pulse transformer has a drum type core including a core and first and second flanges disposed on both ends of the core and installed on a substrate and a primary winding wire and a secondary winding wire wound around the core and provided with an intermediate tap, respectively, wherein first and second terminal electrodes being connected to each of both ends of the primary winding wire and a third terminal electrode for connecting being connected to the intermediate tap of the secondary winding wire are disposed on the surface of the first flange and a fourth terminal electrode being connected to the intermediate tap of the primary winding wire and fifth and sixth terminal electrodes being connected to each of both ends of the secondary winding wire are disposed on the surface of the second flange.

7 Claims, 17 Drawing Sheets

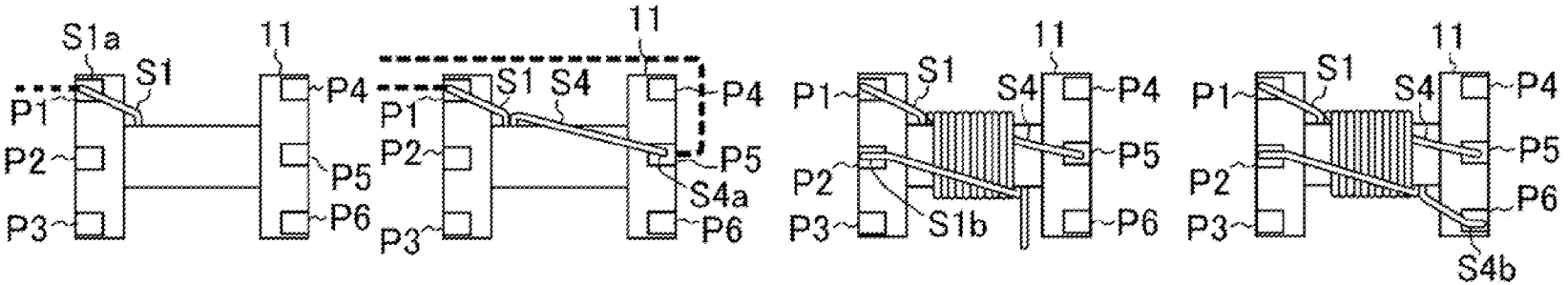
FIG.17A
FIG.17B
FIG.17C
FIG.17D
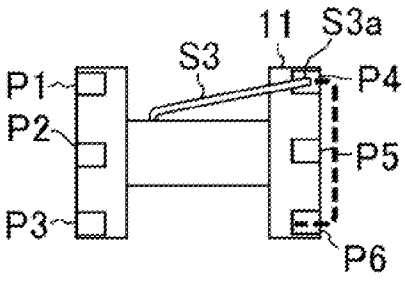
FIG.17E
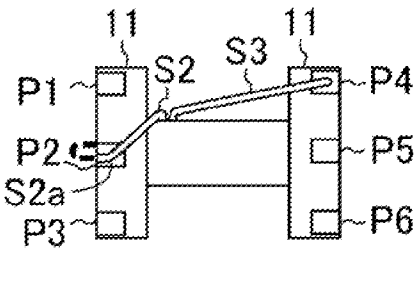
FIG.17F
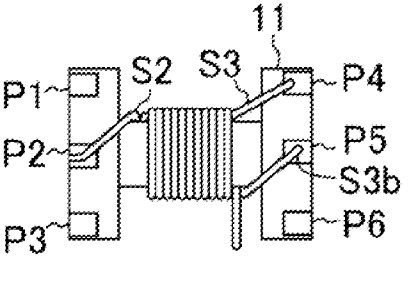
FIG.17G
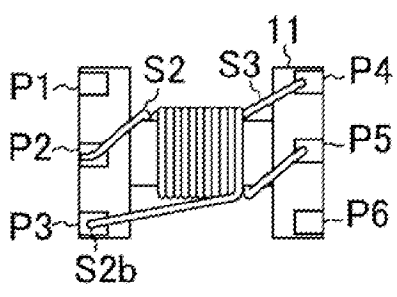
FIG.17H
PRIOR ART

SURFACE MOUNT PULSE TRANSFORMER AND METHOD AND APPARATUS FOR MANUFACTURING THE SAME

TECHNICAL FIELD

The invention relates to a surface mount pulse transformer and a method and an apparatus for manufacturing the same.

BACKGROUND OF THE INVENTION

When equipment such as a personal computer and the like are connected to networks such as a LAN, a phone network, and the like, it is necessary to protect the equipment from an ESD (Electrostatic Discharge) and a high voltage which intrude therein through a cable. To cope with the above problem, a pulse transformer is used for a connector constituting a connection point of the cable and the equipment.

A conventionally used pulse transformer is composed of a doughnut-shaped core (toroidal core) and a primary coil and a secondary coil wound around the core (refer to, for example, Japanese Patent Application Laid-Open No. 7-161535) and has a property for transmitting only the alternating component (pulses) of a voltage applied to the primary coil to the secondary coil. Since a direct current component is not transmitted to the secondary coil, the pulse transformer can shut off the ESD and the high voltage.

Recently, since it is also required to make a pulse transformer compact and surface mountable, examples that use a drum core in place of a toroidal core have been proposed. They are called a surface mount pulse transformer.

FIG. 15 shows a typical arrangement example of the surface mount pulse transformer. FIG. 16 is a view showing an equivalent circuit of the surface mount pulse transformer 1 shown in FIG. 15.

As shown in FIG. 15, the surface mount pulse transformer 1 has a drum type core 2 which includes a core 2*a*, around which wires are wound, and flanges 2*b*, 2*c* disposed on both the ends of the core 2*a*. Three terminal electrodes P1 to P3 and P4 to P6 are disposed on the upper surfaces of the flanges 2*b*, 2*c*, respectively.

As shown in FIGS. 15 and 16, wires S1 to S4 are wound around the core 2*a*, and both the ends S1*a*, S1*b* of the wire S1 are connected to the terminal electrodes P1, P2, both the ends S2*a*, S2*b* of the wire S2 are connected to the terminal electrodes P2, P3, both the ends S3*a*, S3*b* of the wire S3 are connected to the terminal electrodes P4, P5, and both the ends S4*a*, S4*b* of the wire S4 are connected to the terminal electrodes P5, P6, respectively.

The surface mount pulse transformer 1 is a circuit of a balanced input and output. As shown in FIG. 16, the terminal electrodes P1 and P3 act as a plus side terminal IN+ and a minus side terminal IN− of a balanced input, respectively. The terminal electrodes P4 and P6 act as a plus side terminal OUT+ and a minus side terminal OUT− of a balanced output, respectively. The respective wires are wound around the core 2*a* so that an induced current flows from the terminal OUT+ to the terminal OUT− when a current flows from the terminal IN+ to the terminal IN−. The terminal electrodes P2, P5 act as intermediate taps CT on an input side and an output side, respectively.

FIGS. 17A to 17H are views showing a winding process of the surface mount pulse transformer 1. As shown in FIGS. 17A to 17H, the winding process is divided into winding steps shown FIGS. 17A to 17D of a first layer and winding steps shown FIGS. 17E to 17H of a second layer.

The wires S1 and 54 are bifilar wound in the winding steps of the first layer. Specifically, the end S1*a* of the wire S1 is connected to the terminal electrode P1 first (FIG. 17A), and then the end S4*a* of the wire S4 is connected to the terminal electrode P5 (FIG. 17B). The wires S1 and S4 start to be wound together around the core 2*a* from one end side thereof counterclockwise when viewed from the one end side. When the wires S1 and S4 have been wound, the end S1*b* of the wire S1 is connected to the terminal electrode P2 (FIG. 17C), and then the end S4*b* of the wire 54 is connected to the terminal electrode P4 (FIG. 17D).

In the winding steps of the second layer, the wires S2 and S3 are bifilar wound. Note that the wires S1, S4 of the first layer are omitted in FIGS. 17E to 17H. Specifically, the end S3*a* of the wire S3 is connected to the terminal electrode P4 first (FIG. 17E), and then the end S2*a* of the wire S2 is connected to the terminal electrode P2 (FIG. 17F). The wires S2 and S3 start to be wound together around the core 2*a* from one end side thereof counterclockwise when viewed from the one end side. When the wires S2 and S3 have been wound, the end Sib of the wire S3 is connected to the terminal electrode P5 (FIG. 17G), and then the end S2*b* of the wire 2 is connected to the terminal electrode P3 (FIG. 17H).

SUMMARY OF THE INVENTION

However, in the conventional surface mount pulse transformer, since the wires are alternately connected to the flanges 2*b*, 2*c* as shown in FIGS. 17A to 17H, the conventional surface mount pulse transformer has a problem in that when a winding job is performed using an automatic winder which performs a winding job only to one of the flanges at a time, a long time is required for the winding job, which causes increase of manufacturing cost.

Accordingly, an object of the invention is to provide a surface mount pulse transformer capable of reducing a winding job time when a winding job is performed using an automatic winder which performs the winding job only to one of flanges at a time and a manufacturing method and a manufacturing apparatus of the same.

A surface mount pulse transformer according to the invention for achieving the above object is characterized by having a drum type core including a core and first and second flanges disposed on both ends of the core and installed onto a substrate and a primary winding wire and a secondary winding wire wound around the core and provided with an intermediate tap, respectively, wherein first and second terminal electrodes being connected to each of both ends of the primary winding wire and a third terminal electrode being connected to the intermediate tap of the secondary winding wire are disposed on the surface of the first flange and a fourth terminal electrode being connected to the intermediate tap of the primary winding wire and fifth and sixth terminal electrodes being connected to each of both ends of the secondary winding wire are disposed on the surface of the second flange.

According to the invention, both the two terminal electrodes which are connected at the same timing (the first terminal electrode and the third terminal electrode, the fourth terminal electrode and the sixth terminal electrode, the second terminal electrode and the third terminal electrode, and the fourth terminal electrode and the fifth terminal electrode) are located on the one flange. As a result, a winding job time can be reduced when a winding job is performed using an automatic winder capable of performing a wire connection job of only one of flanges at a time.

In the surface mount pulse transformer, the third terminal electrode may be disposed nearer to one end or the other end of the substrate confronting surface of the first flange in a first direction vertical to a magnetic core direction in the substrate surface, and the fourth terminal electrode may be disposed nearer to one end or the other end of the substrate confronting surface of the second flange in the first direction. According to the arrangement, since the first and second terminal electrodes can be disposed away from the third terminal electrode and the fifth and sixth terminal electrodes can be disposed away from the fourth terminal electrode, the primary winding wires can be securely insulated from the secondary winding wires. Further, an increase in size of the surface mount pulse transformer can be suppressed.

In the surface mount pulse transformer, the first and second terminal electrodes may be disposed nearer to one end of the substrate confronting surface of the first flange in the first direction, the third terminal electrode may be disposed nearer to the other end of the substrate confronting surface of the first flange in the first direction, the fourth terminal electrode may be disposed nearer to one end of the substrate confronting surface of the second flange in the first direction, and the fifth and sixth terminal electrodes may be disposed nearer to the other end of the substrate confronting surface of the second flange in the first direction. According to the arrangement, the terminal electrodes relating to the primary winding wires (the first, second, and fourth terminal electrodes) can be disposed away from the terminal electrode relating to the secondary winding wires (the third, fifth, and sixth terminal electrodes) on both the sides of the surface mount pulse transformer in the first direction. As a result, the primary winding wires can be more securely insulated from the secondary winding wires.

In the surface mount pulse transformer, the separation distances between the third terminal electrode and each of the first and second terminal electrodes are longer than the separation distance between the first terminal electrode and the second terminal electrode, and the separation distances between the fourth terminal electrode and each of the fifth and sixth terminal electrodes are longer than the separation distance between the fifth terminal electrode and the sixth terminal electrode. According to the above arrangement, the primary wires can be more securely insulated from the secondary winding wires.

In the surface mount pulse transformer, the primary winding wire may be composed of a first wire connecting between the first terminal electrode and the fourth terminal electrode and a second wire connecting between the fourth terminal electrode and the second terminal electrode, the secondary winding wire may be composed of a third wire connecting between the fifth terminal electrode and the third terminal electrode and a fourth wire connecting between the third terminal electrode and the sixth terminal electrode, and the winding direction of the first and fourth wires may be opposite to the winding direction of the second and third wires when the winding direction from the first flange toward the second flange is viewed from the first flange. According to the above arrangement, when winding of the wires starts and ends, the wires need not be extended from one end to the other end of the core.

In the surface mount pulse transformer, the first to fourth wires may be wound so that the wire-diameter-direction distance between the first wire and the third wire, the wire-diameter-direction distance between the first wire and the fourth wire, the wire-diameter-direction distance between the second wire and the third wire, and the wire-diameter-direction distance between the second wire and the fourth wire are equal to each other in the same turn. According to this arrangement, there can be obtained a surface mount pulse transformer which has good magnetic coupling efficiency and frequency characteristics.

A method of manufacturing a surface mount pulse transformer according to the invention having a drum type core including a core and first and second flanges disposed on both ends of the core and installed on a substrate, and a primary winding wire and a secondary winding wire wound around the core and provided with an intermediate tap, respectively, wherein first and second terminal electrodes being connected to each of both ends of the primary winding wire and a third terminal electrode being connected to the intermediate tap of the secondary winding wire are disposed on the surface of the first flange, and a fourth terminal electrode being connected to the intermediate tap of the primary winding wire and fifth and sixth terminal electrodes being connected to each of both ends of the secondary winding wire are disposed on the surface of the second flange, the manufacturing method being characterized by having the steps of simultaneously connecting a plus side end of the primary winding wire to the first terminal electrode and the intermediate tap of the secondary winding wire to the third terminal electrode, simultaneously connecting the intermediate tap of the primary winding wire to the fourth terminal electrode and a minus side end of the secondary winding wire to the sixth terminal electrode, simultaneously connecting a minus side end of the primary winding wire to the second terminal electrode and the intermediate tap of the secondary winding wire to the third terminal electrode, and simultaneously connecting the intermediate tap of the primary winding wire to the fourth terminal electrode and a plus side end of the secondary winding wire to the fifth terminal electrode.

According to the above arrangement, connecting jobs of the two ends which are connected at the same timing (the plus side end of the primary winding wire and the intermediate tap of the secondary winding wire, the intermediate tap of the primary winding wire and the minus side end of the secondary winding wire, the minus side end of the primary winding wire and the intermediate tap of the secondary winding wire, and the intermediate tap of the primary winding wire and the plus side end of the secondary winding wire) can be simultaneously preformed. As a result, the winding job time can be reduced when the winding job is performed using the automatic winder capable of performing the wire connection job of only one of flanges at a time.

Further, an apparatus for manufacturing a surface mount pulse transformer according to the invention includes a drum type core including a core and first and second flanges disposed on both ends of the core and installed on a substrate and a primary winding wire and a secondary winding wire wound around the core and provided with an intermediate tap, respectively. In the manufacturing apparatus, first and second terminal electrodes being connected to each of both ends of the primary winding wire, and a third terminal electrode being connected to the intermediate tap of the secondary winding wire are disposed on the surface of the first flange, and a fourth terminal electrode being connected to the intermediate tap of the primary winding wire and fifth and sixth terminal electrodes being connected to each of both ends of the secondary winding wire are disposed on the surface of the second flange. The manufacturing apparatus simultaneously connects the plus side end of the primary winding wire to the first terminal electrode and the intermediate tap of the secondary winding wire to the third terminal electrode, simultaneously connects the intermediate tap of the primary winding wire to the fourth terminal electrode and the minus side end of the secondary winding wire to the sixth terminal electrode, simultaneously connects the minus side end of the primary winding wire to the second terminal electrode and the intermediate tap of the secondary winding wire to the third terminal electrode, and simultaneously connects the intermediate tap of the primary winding wire to the fourth terminal electrode and the plus side end of the secondary winding wire to the fifth terminal electrode.

As described above, according to the invention, a winding job time can be reduced when a winding job of a surface mount pulse transformer is performed using an automatic winder capable of performing a wire connection job of only one of flanges at a time.

BRIEF DESCRIPTION OF THE DRAWINGS

FIGS. 2A and 2B are plan views of the surface mount pulse transformer according to the preferred embodiment of the invention, wherein FIG. 2A shows only wires of a first layer, and FIG. 2B shows also wires of a second layer;

FIGS. 17A to 17H are views showing a wire winding process of the surface mount pulse transformer according to the background art of the invention.

DESCRIPTION OF THE PREFERRED EMBODIMENTS

A preferred embodiment of the invention will be described below in detail with reference to the accompanying drawings.

Figure 1:
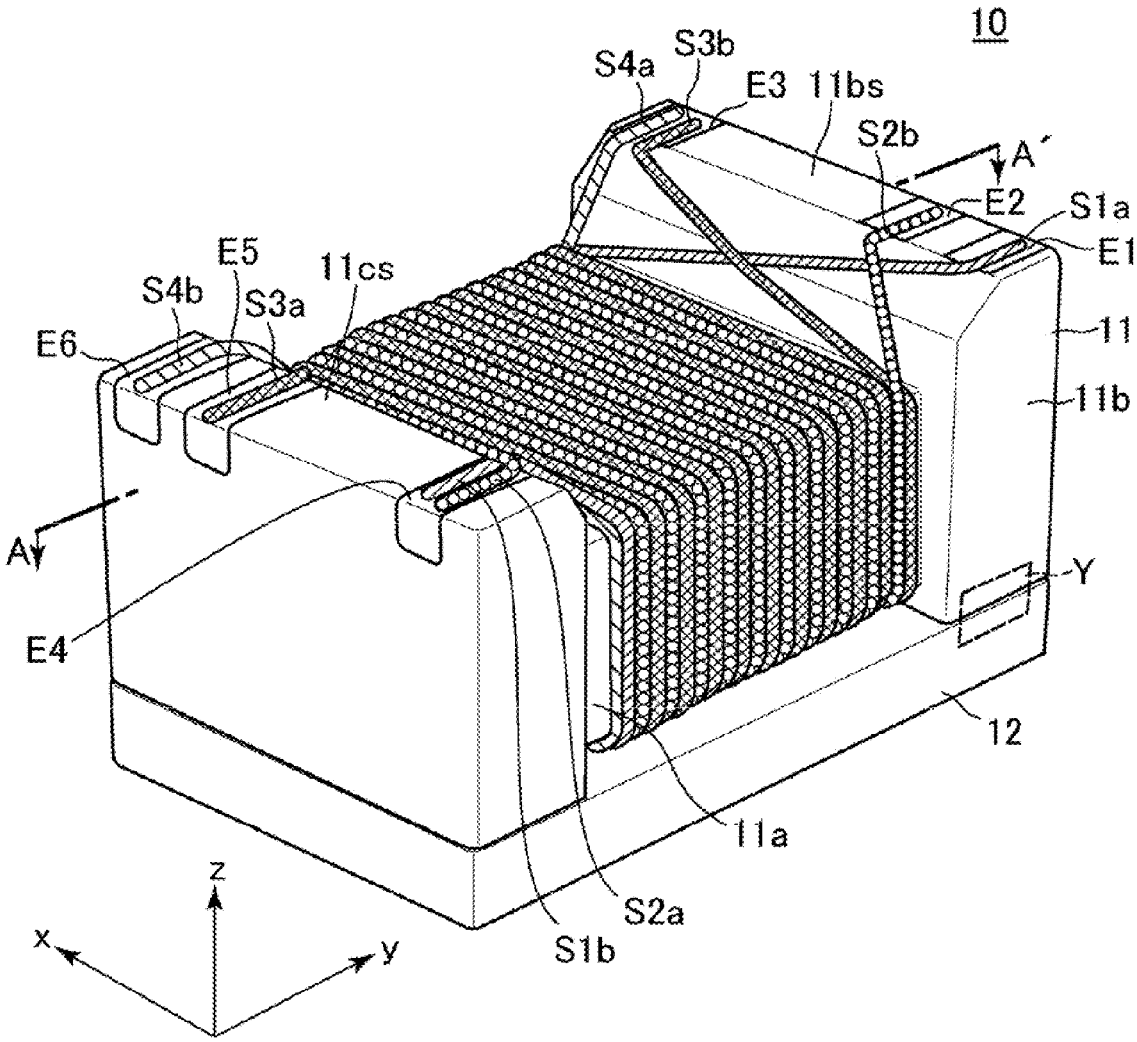
FIG. 1 is a schematic perspective view showing an external appearance structure of a surface mount pulse transformer according to a preferred embodiment of the invention.
Figure 2A:
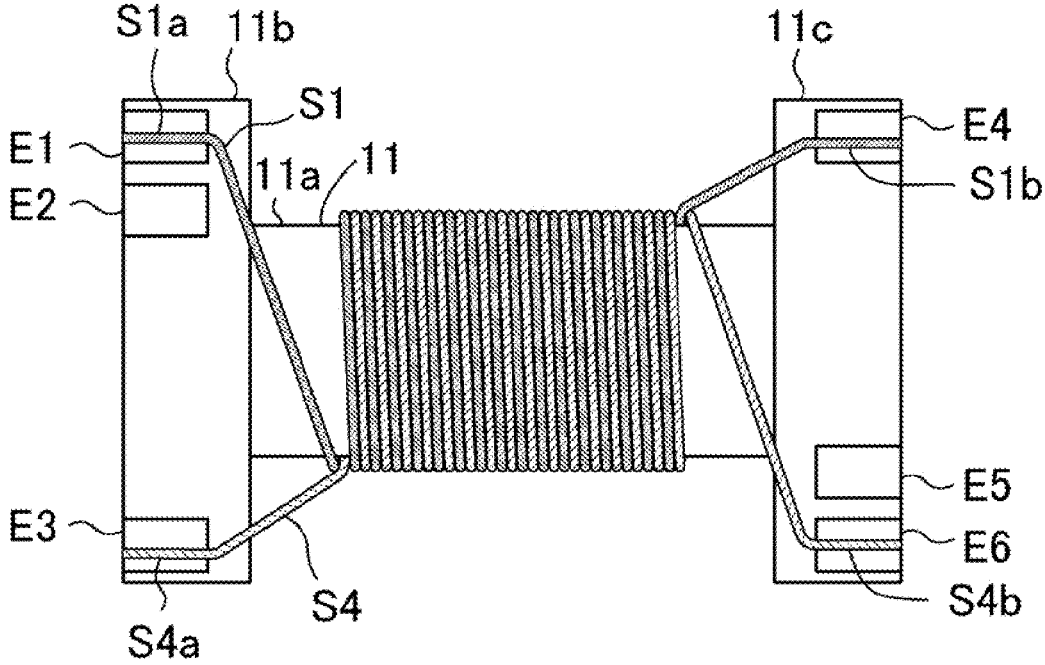
Figure 2B:
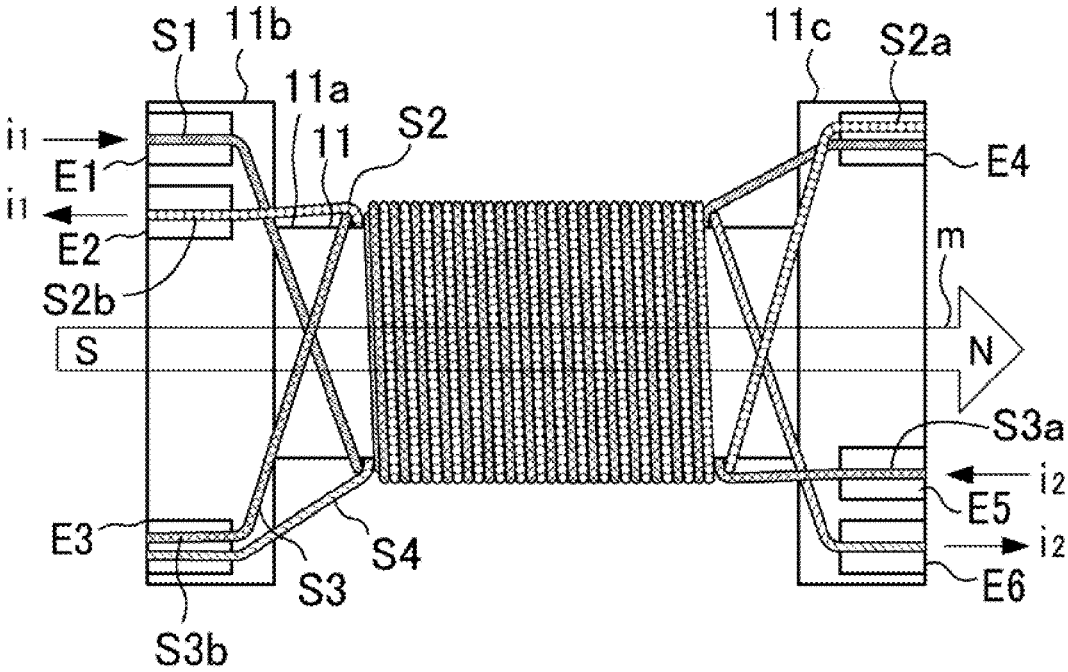
Figure 3:
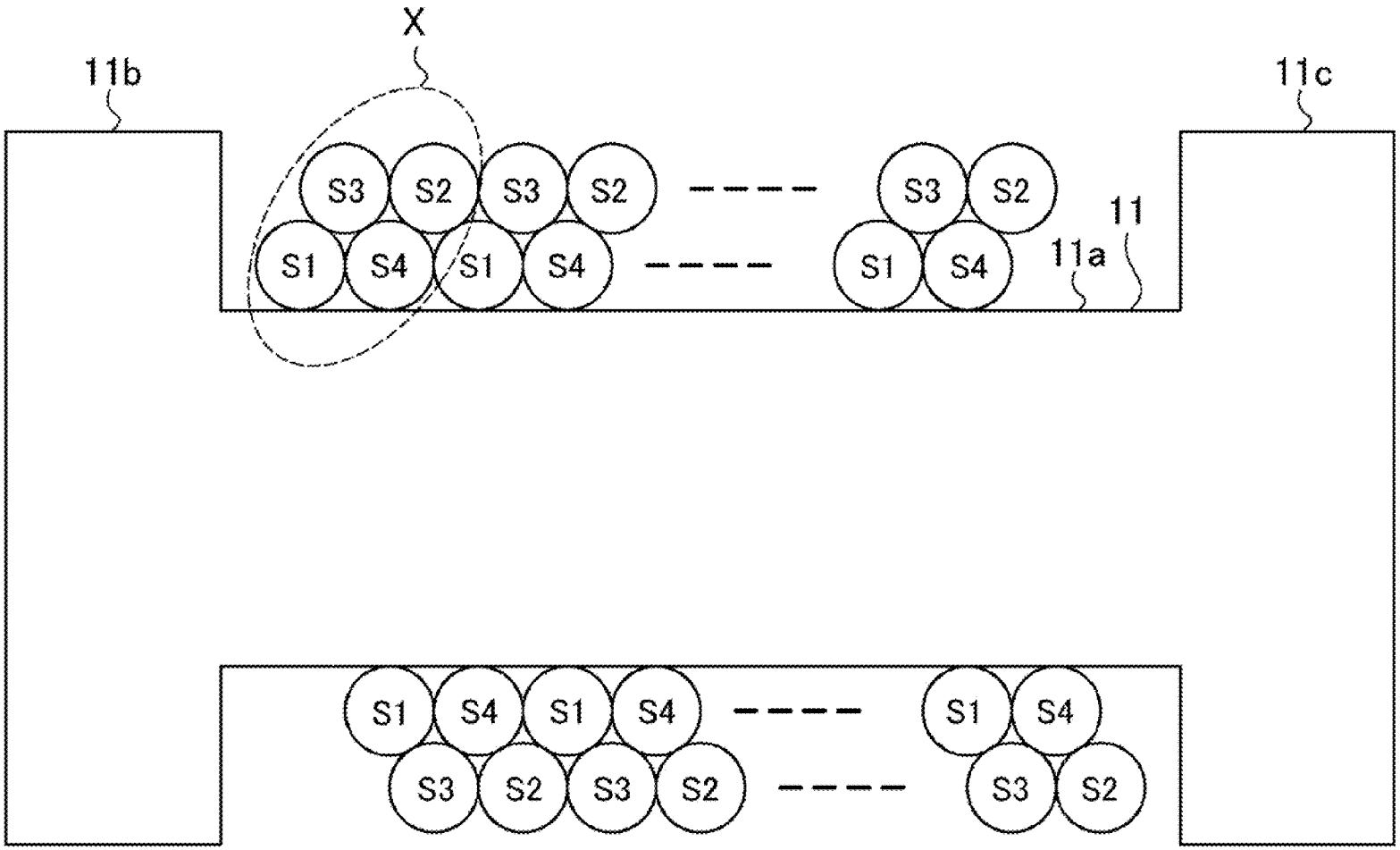
FIG. 3 is a sectional view taken along the line A-A' of FIG. 1 and shows a winding structure of the respective wires in detail.

FIG. 1 is a schematic perspective view showing an external appearance structure of a surface mount pulse transformer 10 according to a preferred embodiment of the invention. FIGS. 2A and 2B are plan views of the surface mount pulse transformer 10. FIG. 2A shows only wires of a first layer, and FIG. 2B shows also wires of a second layer. FIG. 3 is a sectional view taken along the line A-A' of FIG. 1 and shows a winding structure of the respective wires in detail. An arrangement of the surface mount pulse transformer 10 will be described below with reference to the drawings.

As shown in FIGS. 1, 2A and 2B, the surface mount pulse transformer 10 has a drum core 11, a sheet-shaped core 12 attached to the drum core 11, and wires S1 to S4 wound around the drum core 11.

The drum core 11 has a rod-shaped core 11*a* and flanges 11*b*, 11*c* disposed to both ends of the core 11*a* and they are integrated with each other in the structure of the drum core 11. The drum core 11 is placed on a substrate (to be described later) for use and bonded on the substrate with the upper surfaces 11*bs*, 11*cs* of the flanges 11*b*, 11*c* facing the substrate. The sheet-shaped core 12 is securely attached to the lower surfaces (surfaces opposite to the upper surfaces 11*bs*, 11*cs*) of the flanges 11*b*, 11*c*.

Note that the drum core 11 and the sheet-shaped core 12 are made of a magnetic material having relatively higher magnetic permeability, for example, a sintered body of Ni—Zn ferrite and Mn—Zn ferrite. Note that the magnetic material having the high magnetic permeability such as the Mn—Zn ferrite and the like ordinarily has a low specific resistance and conductivity.

Three terminal electrodes E1 to E3 are formed on the upper surface 11*bs* of the flange 11*b*, and three terminal electrodes E4 to E6 are formed on the upper surface 11*cs* of the flange 11*c*. The terminal electrodes E1 to E3 are disposed in this order from one end side in an x-direction (direction perpendicular to a magnetic core direction (a y-direction) in a substrate plane) shown in FIG. 1. Likewise, the terminal electrodes E4 to E6 are also disposed in this order from the one end side of the x-direction. The ends of the wires S1 to S4 are connected to the terminal electrodes E1 to E6 by heat compression bonding.

Note that, as apparent from FIGS. 1, 2A and 2B, the terminal electrode E3 is disposed slightly away from the terminal electrodes E1, E2. The terminal electrode E4 is disposed slightly away from the terminal electrodes E5, E6 likewise. This is for the purpose of securing a withstand voltage between a primary winding wire and a secondary winding wire. This point will be described later in detail again.

The wires S1 to S4 are insulated conductive wires and wound around the core 11*a* in a double-layered structure. That is, as shown in FIGS. 2A and 2B and FIG. 3, a first layer is arranged by bifilar winding the wires S1, S4 (alternately winding the two wires side by side in a single layer), and the wires S2, S3 arrange a second layer by the bifilar winding. The wires S1 to S4 have the same number of turns.

Note that, as shown in FIGS. 2A and 2B, the winding direction of the first layer of the wires S1 to S4 is different from that of the second layer thereof. More specifically, when a winding direction from, for example, the flange 11*b* toward the flange 11*c* is viewed from the flange 11*b*, the wires S1, S4 are wound in a clockwise direction, whereas the wires S2, S3 are wound in a counterclockwise direction, that is, the wires S1, S4 and the wires S2, S3 are wound in an opposite direction. This is for the purpose of making it not necessary to extend the respective wires from one end of the core 11*a* to the other end thereof when the winding of them starts and ends, the details of which will be described later.

How the wires S1 to S4 are connected to the terminal electrodes E1 to E6 will be described. As shown in FIG. 2A, one end S1*a* and the other end S1*b* of the wire S1 are connected to the terminal electrodes E1, E4, respectively, and one end S4*a* and the other end S4*b* of the wire S4 are connected to the terminal electrodes E3, E6, respectively. As shown in FIG. 2B, one end S2*a* and the other end S2*b* of the wire S2 are connected to the terminal electrodes E4, E2, respectively. Further, one end S1*a* and the other end S3*b* of the wire S3 are connected to the terminal electrodes E5, E3, respectively.

Figure 4:
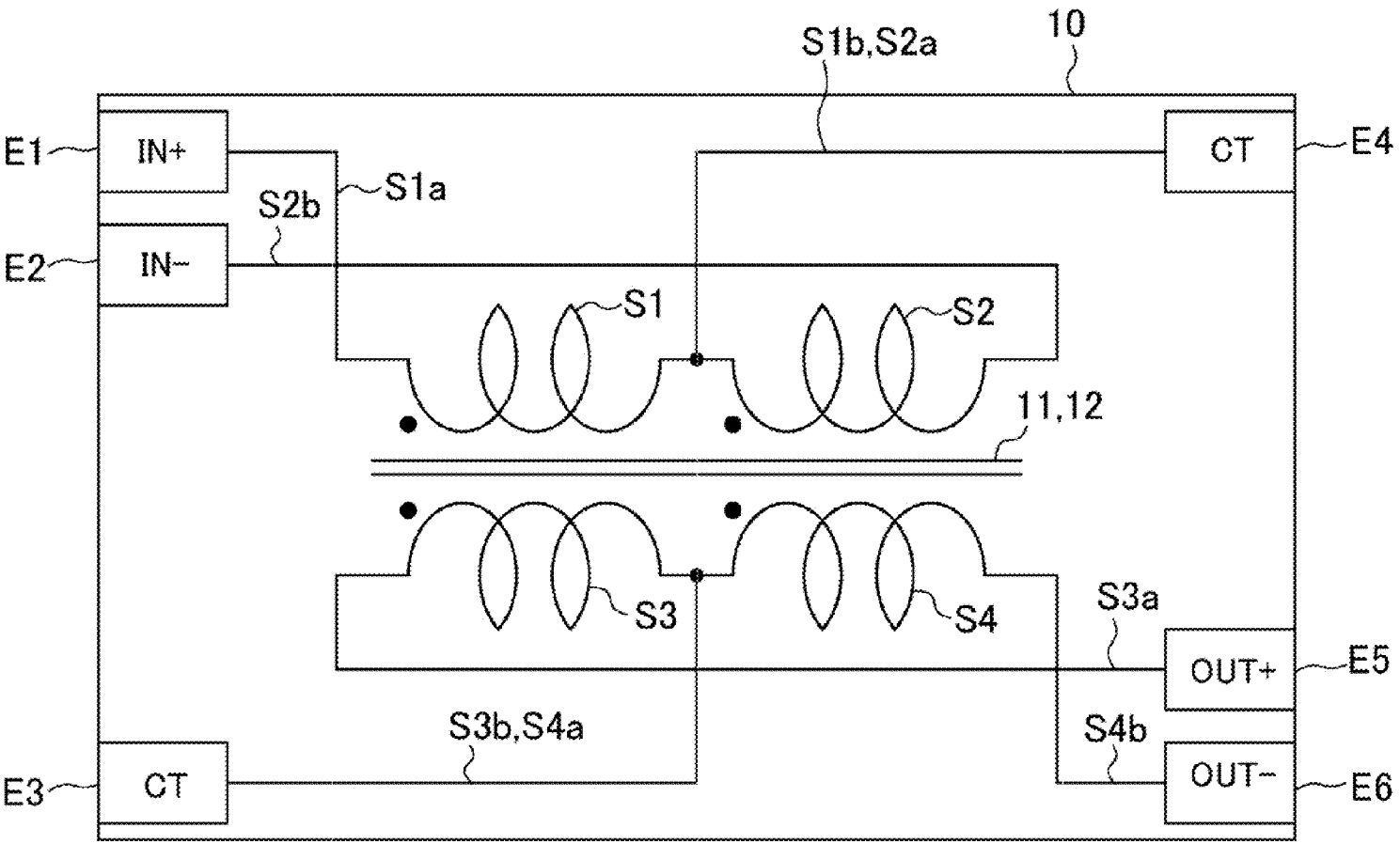
FIG. 4 is a view showing an equivalent circuit of the surface mount pulse transformer according to the preferred embodiment of the invention.

FIG. 4 is an equivalent circuit of the surface mount pulse transformer 10 realized by the arrangement described above.

As shown in FIG. 4, the terminal electrodes E1, E2 act as a plus side terminal IN+ and a minus side terminal IN− of a balanced input, respectively. Further, the terminal electrode E5, E6 act as a plus side terminal OUT+ and a minus side terminal OUT− of a balanced output, respectively. The terminal electrodes E3, E4 act as intermediate taps CT on an input side and an output side, respectively. The wires S1, S2 constitute the primary winding wire of the surface mount pulse transformer 10, and the wires S3, S4 constitute the secondary winding wire of the surface mount pulse transformer 10. Further, the drum core 11 and the sheet-shaped core 12 constitute a closed magnetic path of the surface mount pulse transformer 10.

The operation of the surface mount pulse transformer 10 will be described in more detail again with reference to FIG. 2B. FIG. 2B shows a balanced input current $i_1$ and a balanced output current $i_2$ of the surface mount pulse transformer 10 and also a magnetic field m generated in the core 11*a* in operation. As shown in FIG. 2B, when the balanced input current $i_1$ flows to the terminal electrodes E1, E2, the magnetic field m is generated in the core 11*a* around which the wires S1, S2 are wound, the magnetic field m having an S-pole on the flange 11*b* side and an N-pole on the flange 11*c* side. The magnetic field m causes the wires S3, S4 to generate an induced current which becomes the balanced output current $i_2$. Accordingly, the equivalent circuit shown in FIG. 4 is realized.

As described above, the winding direction of the wires S1, S4 is opposite to that of the wires S2, S3. With this arrangement, it is possible to start and end the winding of the respective wires at the positions nearest to the flanges where they are connected. That is, when it is assumed that the winding direction of the wires S1, S4 is the same as that of the wires S2, S3, it is necessary to extend the wires S2, S3 to the flange 11*c* side and to start winding of them after they are connected to the terminal electrode E2, E3 and to extend them from the flange 11*b* side to the terminal electrodes E4, E5 and to connect them when the winding of them is ended in order to cause the surface mount pulse transformer 10 to perform the above operation (in particular, to generate the balanced output current $i_2$ by the magnetic field m). However, the extension of the wires is not necessary in the surface mount pulse transformer 10.

Figure 5:
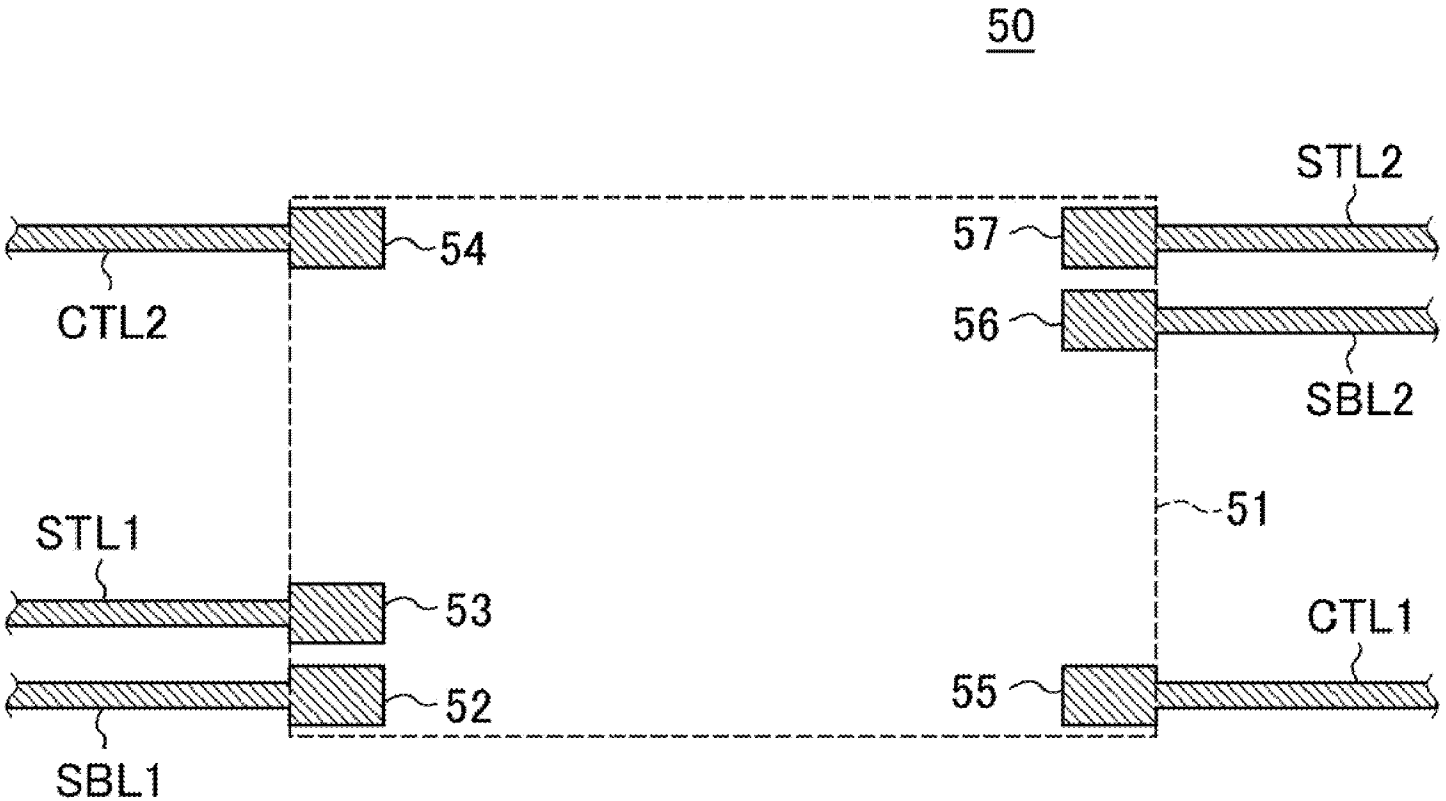
FIG. 5 is a plan view of a print substrate on which the surface mount pulse transformer according to the preferred embodiment of the invention is mounted.

FIG. 5 is a plan view of a print substrate 50 on which the surface mount pulse transformer 10 is mounted.

A region 51 on the print substrate 50 shown in FIG. 5 is a region on which the surface mount pulse transformer 10 is mounted. As shown in FIG. 5, six land patterns 52 to 57 are disposed on the mounting region 51. The land patterns 52, 53 are patterns connected to a pair of balanced transmission lines STL1, SBL1 and connected to the terminal electrodes E1, E2 of the surface mount pulse transformer 10. The land patterns 56, 57 are patterns connected to a pair of balanced transmission lines STL2, STL2 and connected to the terminal electrodes E5, E6 of the surface mount pulse transformer 10. The land patterns 54, 55 are patterns connected to intermediate tap lines CTL2, CTL1 of the secondary winding wire (wires S3, S4) and the primary winding wire (wires S1, S2) of the surface mount pulse transformer 10, respectively and connected to the terminal electrodes E3, E4 of the surface mount pulse transformer 10.

With this layout, the balanced transmission lines STL1, SBL1 and the balanced transmission lines STL2, STL2 can be linearly formed in parallel with each other. As a result, since it is not necessary to bypass wiring patterns on the print substrate, an area occupied by the wiring patterns does not increase more than necessary and moreover symmetry of the wiring patterns can be secured. Accordingly, reduction in size of the overall surface mount pulse transformer can be compatible with an improvement of signal quality.

Note that the intermediate tap lines CTL1, CTL2 are individually disposed in FIG. 5. However, when the intermediate taps are simply connected to the ground, the one intermediate tap line CTL may be connected to both the land patterns 54, 55.

Next, a manufacturing apparatus (automatic winder) and a manufacturing method of the surface mount pulse transformer 10 will be described.

FIGS. 6 to 13 are views showing an arrangement of the automatic winder 70 for performing a wire winding job of the surface mount pulse transformer 10 and the respective steps of a winding job performed by the automatic winder 70.

Figure 6:
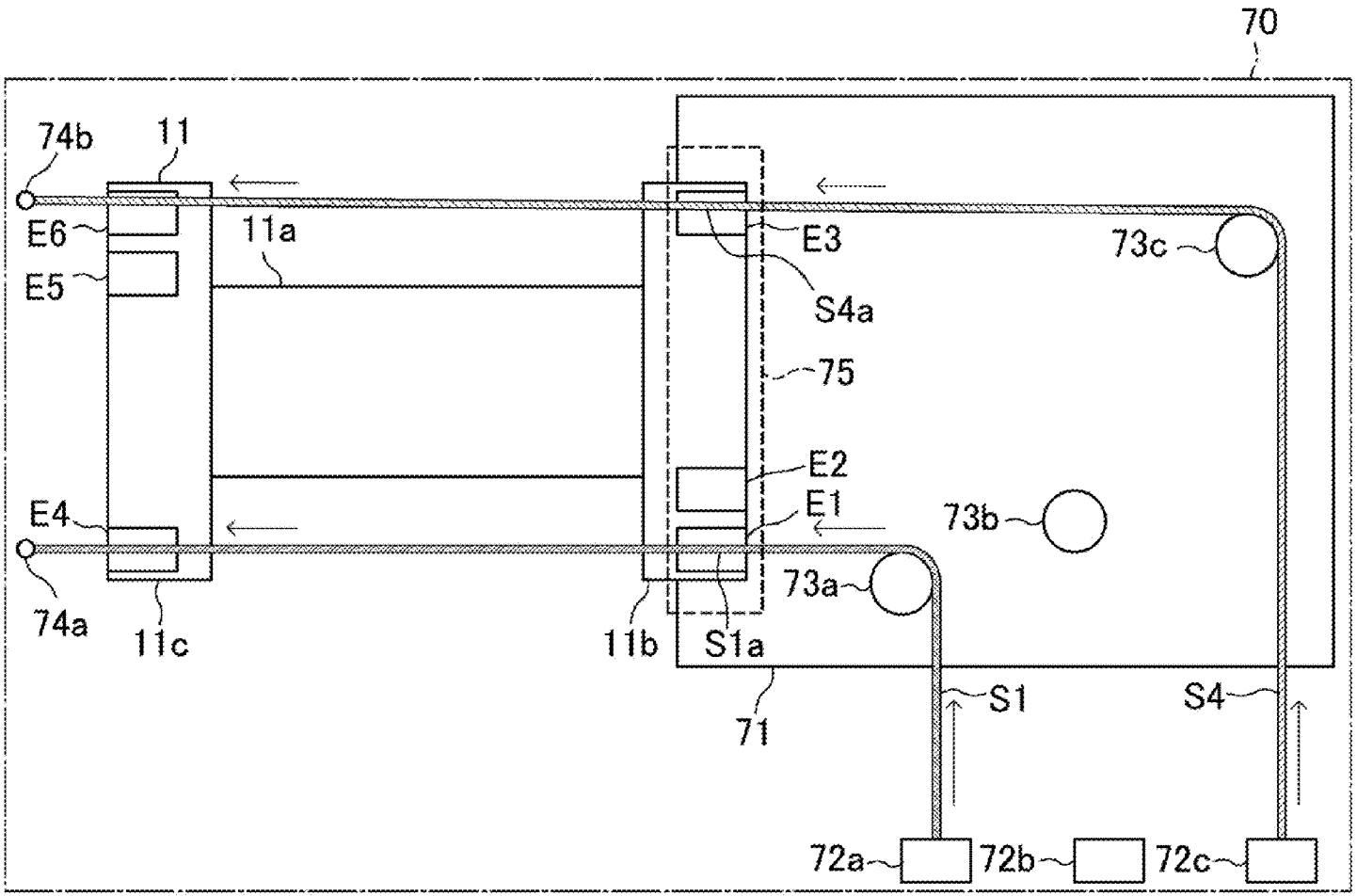
FIG. 6 is a view showing an arrangement of an automatic winder for performing a wire winding job of the surface mount pulse transformer according to the preferred embodiment of the invention and steps of the winding job performed by the automatic winder.
Figure 7:
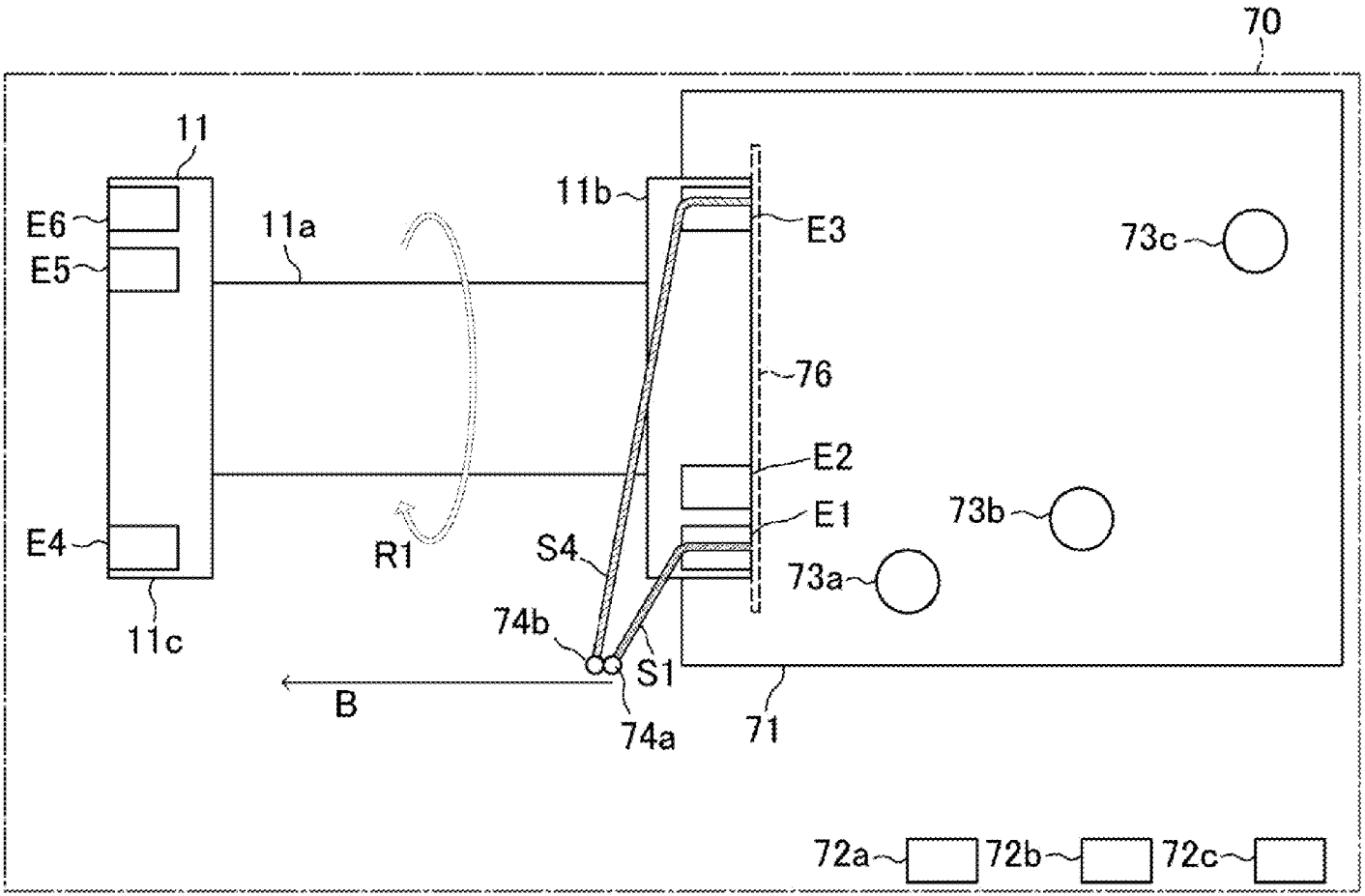
FIG. 7 is a view showing the arrangement of the automatic winder for performing the wire winding job of the surface mount pulse transformer according to the preferred embodiment of the invention and steps of the winding job performed by the automatic winder.

First, the arrangement of the automatic winder 70 will be described. As shown in FIGS. 6 and 7, the automatic winder 70 has a base 71 for fixing the drum core 11 by the flange 11*b*, three fixing units 72*a* to 72*c* for temporarily fixing wires, three guide pins 73*a* to 73*c* disposed on one side of the drum core 11, two nozzles 74*a*, 74*b* for drawing wires fed out from bobbins which are not shown, a heater 75 (FIG. 6 shows only a shape of the contact surface of the heater in contact with the flange by a dotted line), and a cutter 76 (FIG. 7 shows only a cross sectional shape of the cutter by a dotted line).

Note that since the automatic winder 70 has only each one set of the heater 75 and the cutter 76 for performing the connection job, it cannot perform the connection job in both the two flanges at a time.

As shown in FIG. 6, the automatic winder 70 first fixes the wires fed out from the nozzles 74*a*, 74*b* to the fixing units 72*a*, 72*c*, respectively. Note that the wires fed out from the nozzles 74*a*, 74*b* at the time become the wires S1, S4, respectively.

Next, the automatic winder 70 moves the nozzles 74*a*, 74*b* to the vicinity of the flange 11*c* through the guide pins 73*a*, 73*c*, respectively. With this operation, the wires S1, S4 pass above the terminal electrodes E1, E3, respectively.

The automatic winder 70 moves the heater 75 above the flange 11*b* in the state that the wires S1, S4 are located above the terminal electrodes E1, E3 and further lowers the heater 75 so that the heater 75 comes into contact with the surface of the flange 11*b*. With this operation, the wires S1, S4 are thermo-compression bonded to the terminal electrodes E1, E3, and the thermo-compression bonded portions of the wires S1, S4 become the ends S1*a*, S4*a*, respectively.

On the completion of thermo-compression bonding, the automatic winder 70 moves the heater 75, next lowers the cutter 76 along the end of the flange 11*b* opposite to the core 11*a* of the flange 11*b* as shown in FIG. 7, and the wires S1, S4 are cut by the cutter 76.

Figure 8:
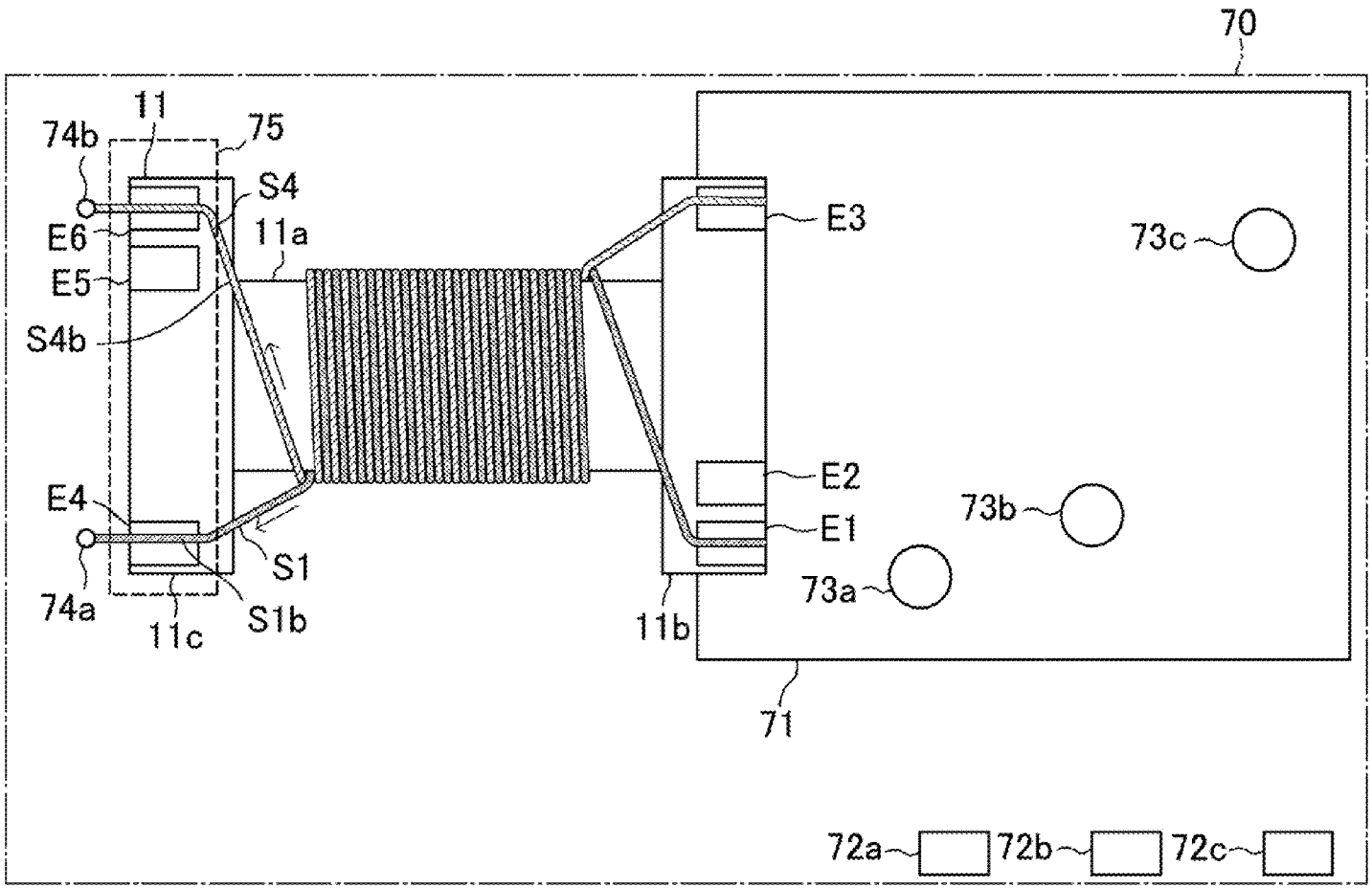
FIG. 8 is a view showing the arrangement of the automatic winder for performing the wire winding job of the surface mount pulse transformer according to the preferred embodiment of the invention and steps of the winding job performed by the automatic winder.

Next, as shown in FIG. 7, the automatic winder 70 moves the nozzles 74*a*, 74*b* to the vicinity of the flange 11*b* and disposes them adjacent to each other so that the nozzle 74*a* is located on the flange 11*b* side when viewed from the nozzle 74*b*. Then, the nozzles 74*a*, 74*b* are moved from the positions along a direction B shown in FIG. 7. At the same time, the drum core 11 is rotated in a direction R1 shown in FIG. 7 about a magnetic core direction. With these operations, the wires S1, S4 are bifilar wound around the core 11*a* as shown in FIG. 8. Note that the automatic winder 70 controls the rotation speed of the drum core 11 and the operation of the nozzles 74*a*, 74*b* so that the respective wires have a positional relationship shown in FIG. 3.

When the wires S1, S4 have been wound for a necessary number of turns, the automatic winder 70 draws the wires S1, S4 above the terminal electrodes E4, E6 by moving the nozzles 74*a*, 74*b* across above the terminal electrodes E4, E6, respectively and further moves the heater 75 above the flange 11*c* and lowers it so that it comes into contact with the surface of the flange 11*c*. With this operation, the wires S1, S4 are thermo-compression bonded to the terminal electrodes E4, E6, and the thermo-compression bonded portions of them become the ends S1*b*, S4*b*, respectively.

Figure 9:
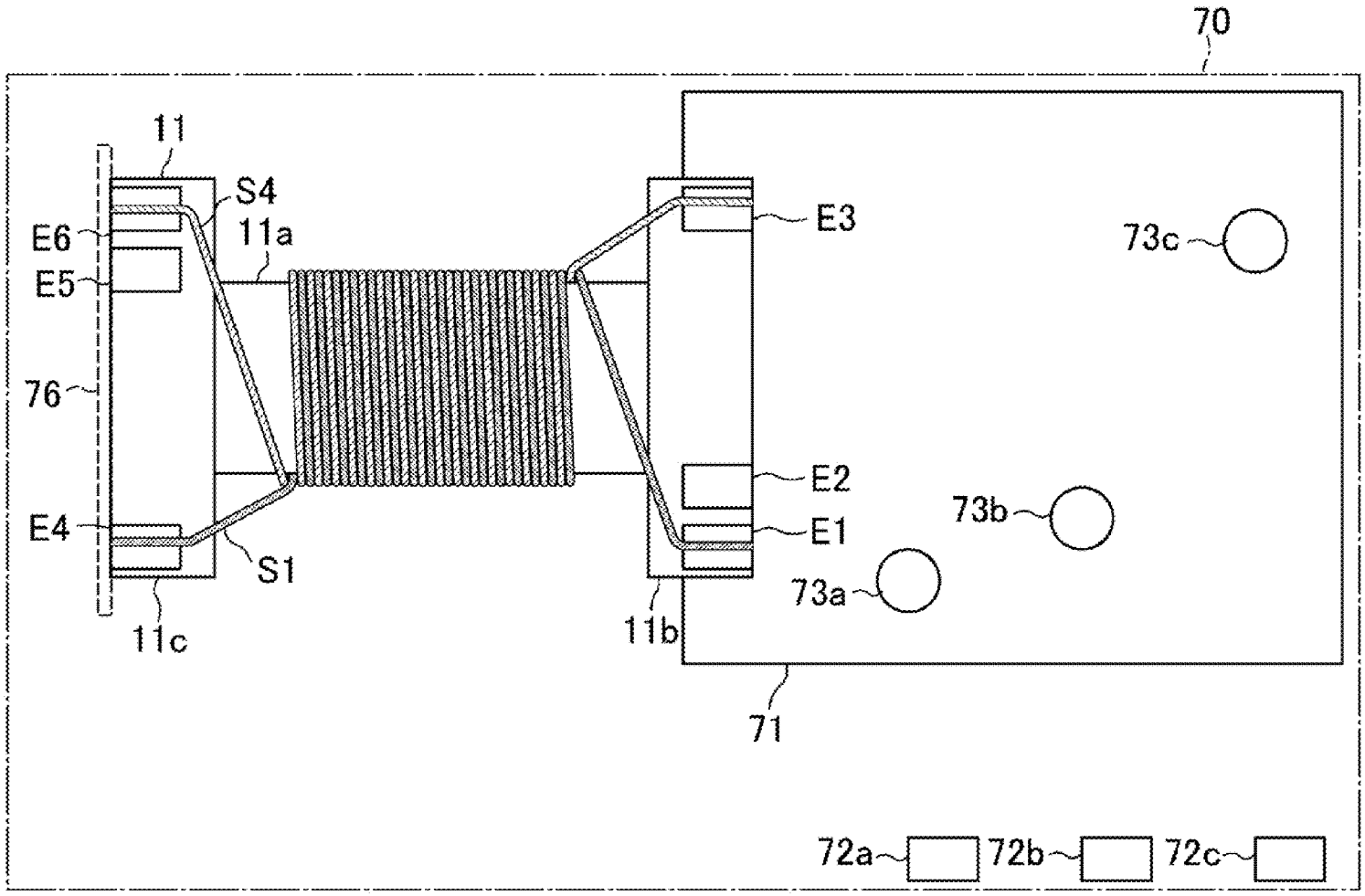
FIG. 9 is a view showing the arrangement of the automatic winder for performing the wire winding job of the surface mount pulse transformer according to the preferred embodiment of the invention and steps of the winding job performed by the automatic winder.

On the completion of thermo-compression bonding, the automatic winder 70 moves the heater 75, next lowers the cutter 76 along the end of the flange 11*c* opposite to the core 11*a* as shown in FIG. 9, and the wires S1, S4 are cut by the cutter 76. In this manner, the winding job of the first layer is completed.

Figure 10:
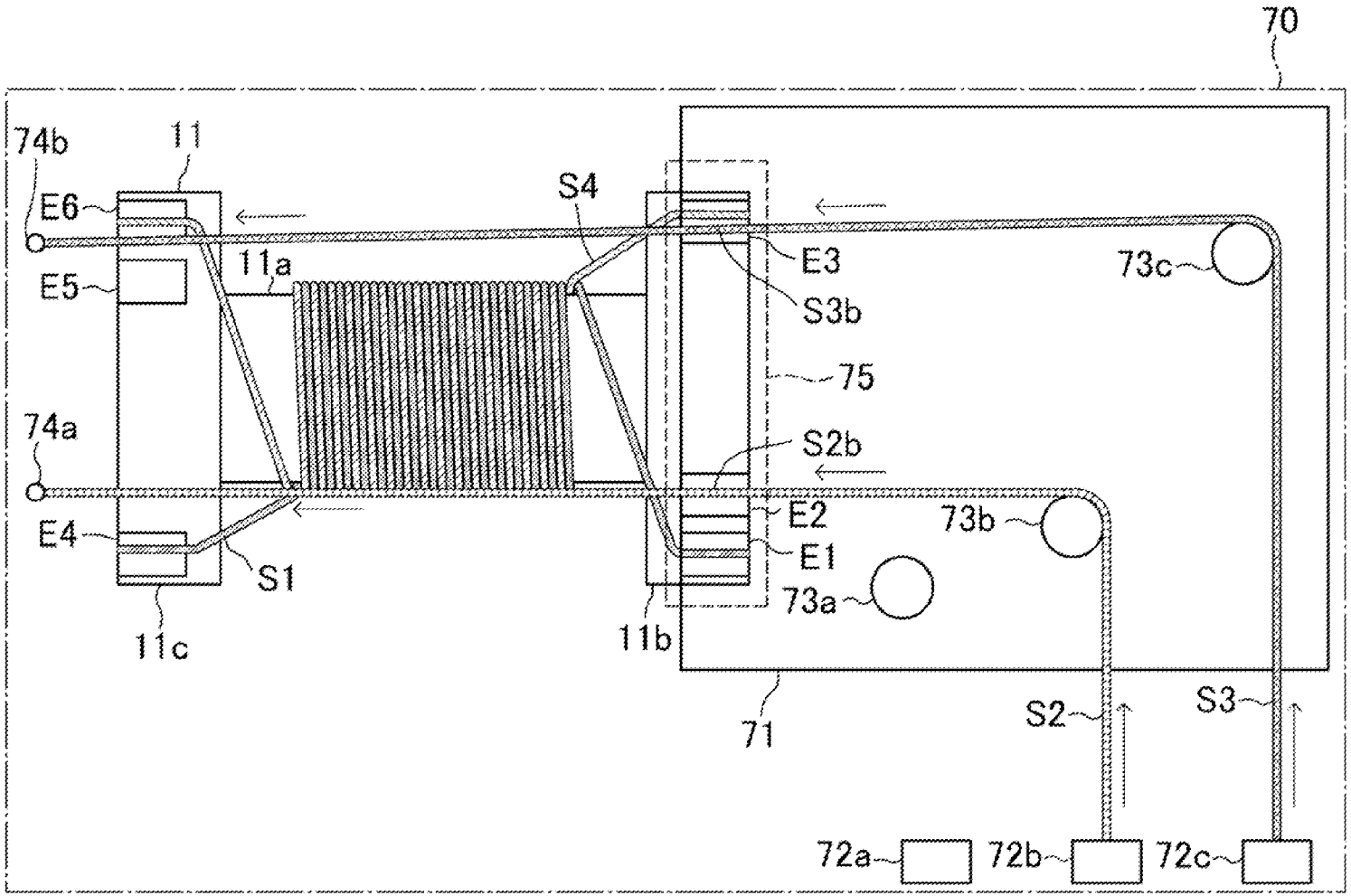
FIG. 10 is a view showing the arrangement of the automatic winder for performing the wire winding job of the surface mount pulse transformer according to the preferred embodiment of the invention and steps of the winding job performed by the automatic winder.

In the second layer, the automatic winder 70 first fixes the wires fed out from the nozzles 74*a*, 74*b* to the fixing units 72*b*, 72*c*, respectively as shown in FIG. 10. Note that the wires fed out from the nozzles 74*a*, 74*b* at the time become the wires S2, S3, respectively.

Next, the automatic winder 70 moves the nozzles 74*a*, 74*b* to the vicinity of the flange 11*c* through the guide pins 73*b*, 73*c*, respectively. With this operation, the wires S2, S3 pass above the terminal electrodes E2, E3, respectively. The nozzle 74*b* is preferably moved from the guide pin 73*c* to the flange 11*c* slightly obliquely to the magnetic core direction so that the wire S3 does not overlap with the wire S4 on the terminal electrode E3.

The automatic winder 70 moves the heater 75 above the flange 11*b* with the wires S2, S3 being located above the terminal electrodes E2, E3, and further lowers the heater 75 so as to be in contact with the surface of the flange 11*b*. With this operation, the wires S2, S3 are thermo-compression bonded to the terminal electrodes E2, E3, and the thermo-compression bonded portions of the wires S2 and S3 become the ends S2*b*, S3*b*, respectively.

Figure 11:
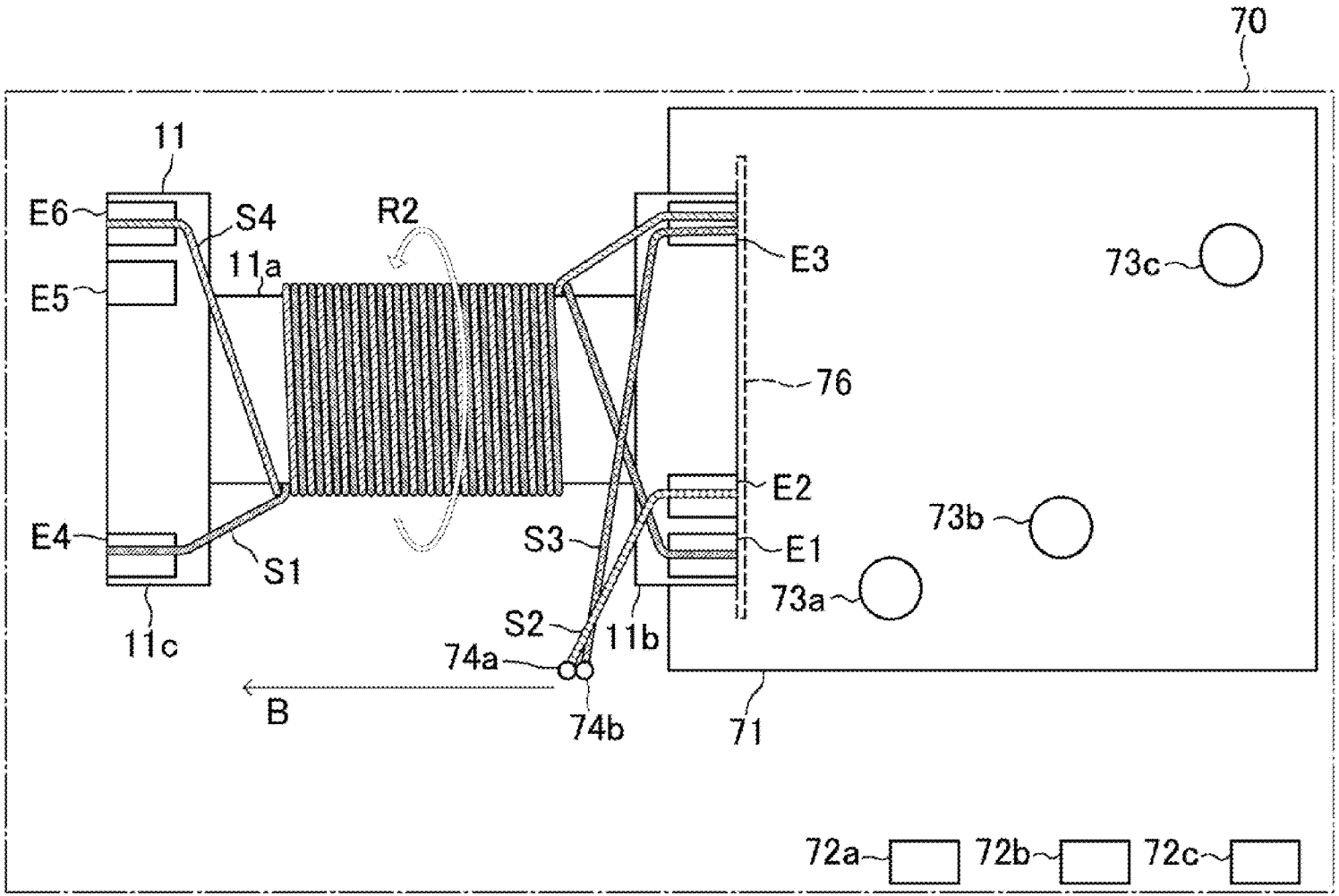
FIG. 11 is a view showing the arrangement of the automatic winder for performing the wire winding job of the surface mount pulse transformer according to the preferred embodiment of the invention and steps of the winding job performed by the automatic winder.

On the completion of thermo-compression bonding, the automatic winder 70 moves the heater 75, next lowers the cutter 76 along the end of the flange 11*b* opposite to the core 11*a* as shown in FIG. 11, and the wires S2, S3 are cut by the cutter 76.

Figure 12:
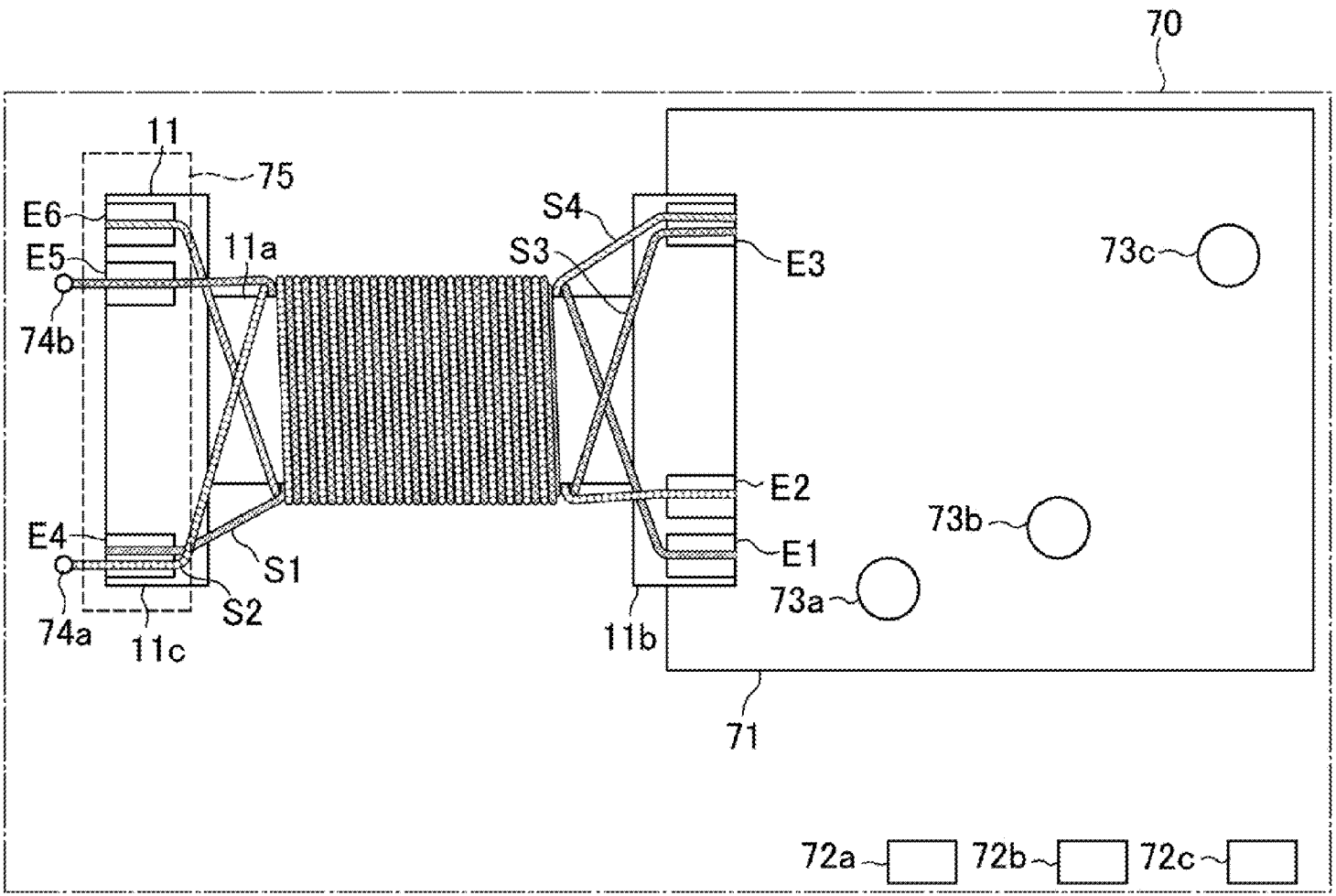
FIG. 12 is a view showing the arrangement of the automatic winder for performing the wire winding job of the surface mount pulse transformer according to the preferred embodiment of the invention and steps of the winding job performed by the automatic winder.

Next, as shown in FIG. 11, the automatic winder 70 moves the nozzles 74*a*, 74*b* to the vicinity of the flange 11*b* and disposes them adjacent to each other so that the nozzle 74*b* is disposed to the flange 11*b* side when viewed from the nozzle 74*a*. Then, the nozzles 74*a*, 74*b* are moved from the positions along a direction B shown in FIG. 11. At the same time, the drum core 11 is rotated in a direction R2 shown in FIG. 11 about the magnetic core direction. The direction R2 is opposite to the direction R1 described above. With these operations, the wires S2, S3 are bifilar wound on the wires S1, S2 already wound around the core 11*a* as shown in FIG. 12. Note that the automatic winder 70 controls the rotation speed of the drum core 11 and the operation of the nozzles 74*a*, 74*b* so that the respective wires have the positional relationship shown in FIG. 3.

When the wires S2, S3 have been wound for a necessary number of turns, the automatic winder 70 draws the wires S2, S3 above the terminal electrodes E4, E5 by moving the nozzles 74*a*, 74*b* across above the terminal electrodes E4, E5, respectively and further moves the heater 75 above the flange 11*c* and lowers the heater 75 so as to be in contact with the surface of the flange 11*c*. With this operation, the wires S2, S3 are thermo-compression bonded to the terminal electrodes E4, E5, and the thermo-compression bonded portions of the wires S2 and S3 become the ends S2*a*, S1*a*, respectively.

Figure 13:
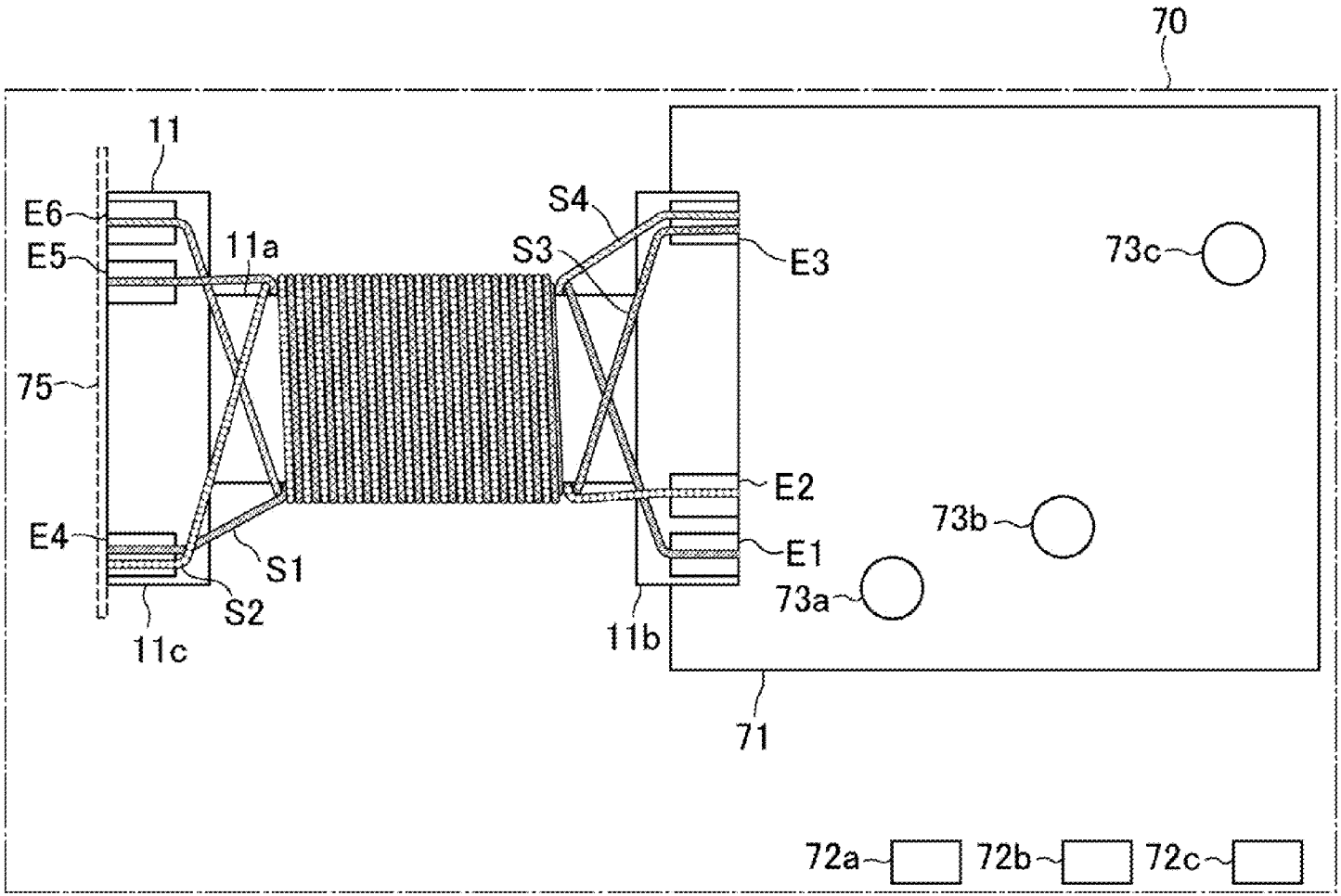
FIG. 13 is a view showing the arrangement of the automatic winder for performing the wire winding job of the surface mount pulse transformer according to the preferred embodiment of the invention and steps of the winding job performed by the automatic winder.

On the completion of thermo-compression bonding, the automatic winder 70 moves the heater 75, next lowers the cutter 76 along the end of the flange 11*c* opposite to the core 11*a* as shown in FIG. 13, and the wires S2, S3 are cut by the cutter 76. In this manner, the winding job of the second layer is completed.

As described above, the automatic winder 70 simultaneously performs the connection job (thermo-compression bonding by the heater 75 and the cutting by the cutter 76) of the two ends (the ends S1*a* and S4*a*, the ends S1*b* and S4*b*, the ends S2*b* and S3*b*, and the ends S2*a* and S3*a*) to be connected at the same timing, respectively. Accordingly, a winding job time is greatly reduced in comparison with the winding job time of the background Art (FIG. 17) in which each two ends of the wires are independently connected. Specifically, 44 seconds were required by a winding job in the surface mount pulse transformer 1 performed by the background art using the automatic winder. However, a winding job in the surface mount pulse transformer 10 using the automatic winder 70 can be finished in 18 seconds.

Reduction of the winding job time is realized by the arrangement of the surface mount pulse transformer 10 and the arrangement of the automatic winder 70 corresponding to the arrangement of the surface mount pulse transformer 10 each described above.

First, in the surface mount pulse transformer 10, the respective two ends (the ends S1*a* and S4*a*, the ends S1*b* and S4*b*, the ends S2*b* and S3*b*, and the ends S2*a* and S1*a*) to be connected at the same timing are located to the one flange. With this arrangement, an automatic winder such as the automatic winder 70, which performs a connection job only in one of the flanges at a time, can simultaneously connect two ends.

Next, in the automatic winder 70, since the three guide pins 73*a* to 73*c* are disposed on the one side of the drum core 11, the respective wires can be drawn above the terminal electrodes from the same direction by moving the nozzles 74*a*, 74*b*. With this operation, when, for example, the ends S1*a*, S4*a* are connected to the terminal electrodes E1, E3, since the wires S1, S4 can be drawn above the terminal electrodes E1, E3 from the same side of the drum core 11, the two ends can be connected at the same time.

Conversely, in the automatic winder 70, it is not necessary to dispose the guide pins 73*a* to 73*c* on both the sides of the drum core 11. With this arrangement, the automatic winder can be arranged simply.

The other advantages achieved by the surface mount pulse transformer 10 will be described below.

In the surface mount pulse transformer 10, since the terminal electrodes, to which the primary winding wire (the wires S1, S2) are connected, and the terminal electrodes, to which the secondary winding wire are connected, are disposed on the same flange, a certain degree of a distance must be provided between the former terminal electrodes and the latter terminal electrodes to secure a withstand voltage between the primary winding wire and the secondary winding wire. Although the size of the drum core 11 is increased by the above arrangement, the surface mount pulse transformer 10 can suppress an increase of its size. This will be described below in detail.

Figure 14:
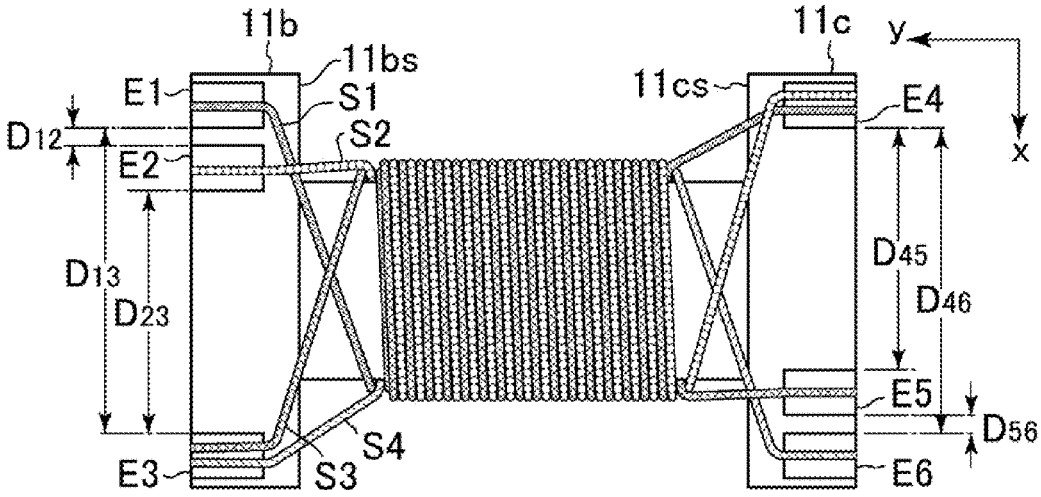
FIG. 14 is a plan view of the surface mount pulse transformer according to the preferred embodiment of the invention.
Figure 15:
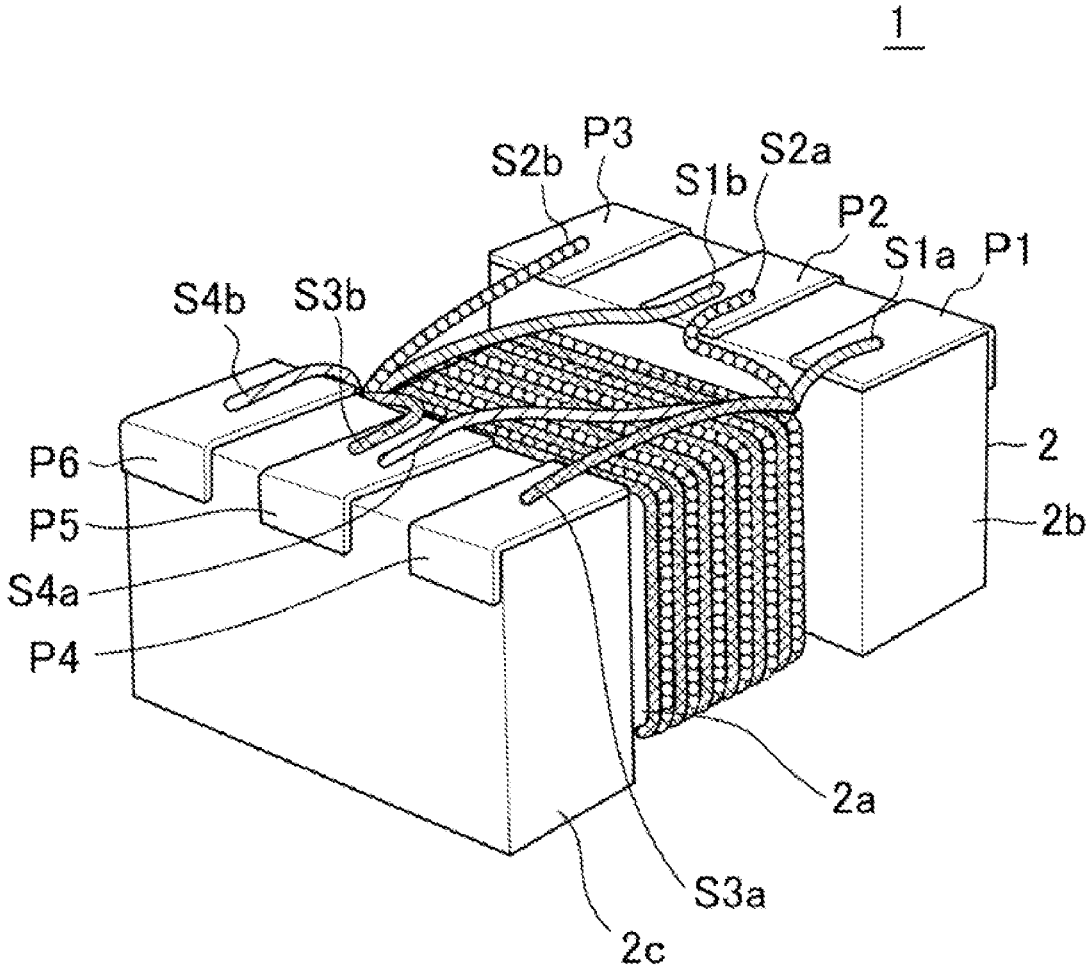
FIG.15 PRIOR ART
FIG. 15 is a schematic perspective view showing an external appearance structure of a surface mount pulse transformer according to a background art of the invention.
Figure 16:
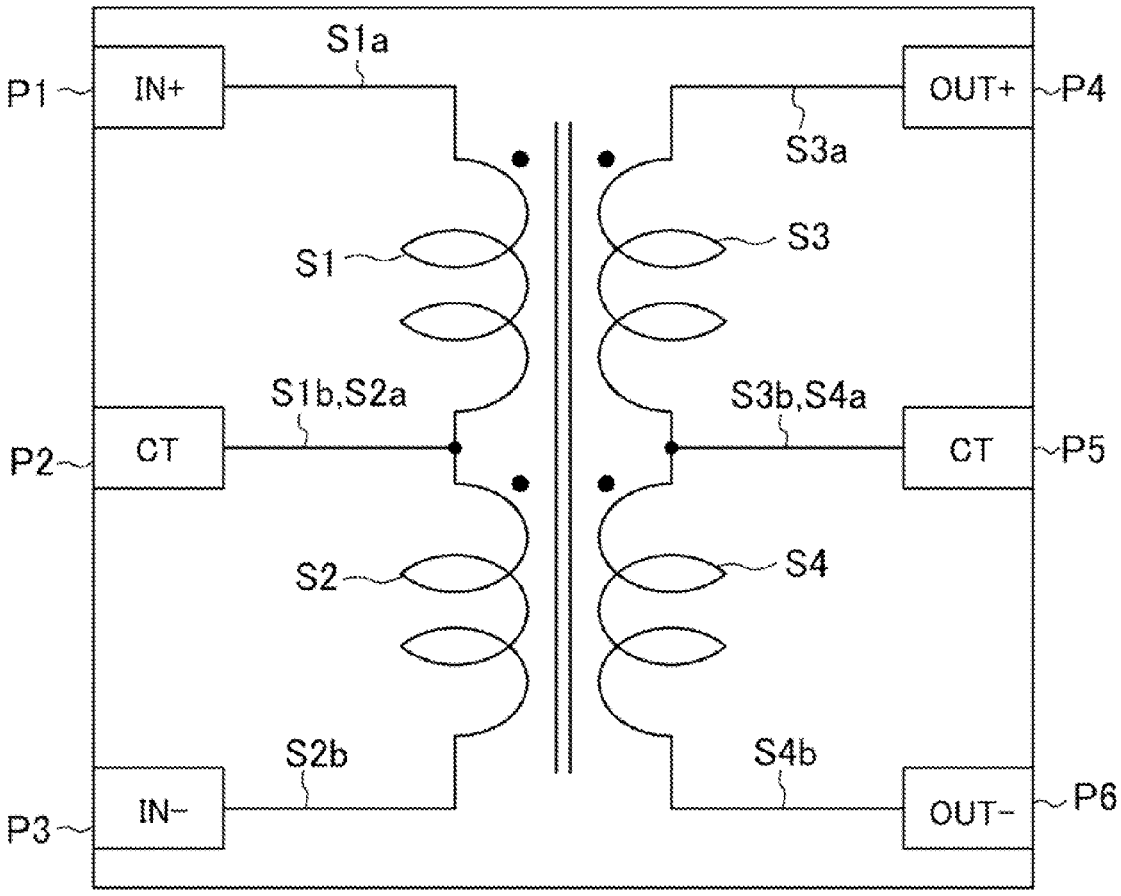
FIG.16 PRIOR ART
FIG. 16 is a view showing an equivalent circuit of the surface mount pulse transformer according to the background art of the invention.

FIG. 14 is a plan view of the surface mount pulse transformer 10 which is shown also in FIG. 2B. As shown in FIG. 14, the terminal electrodes E1, E2 are disposed nearer to one end of the substrate-confronting surface 11*bs* of the flange 11*b* in an x-direction, and the terminal electrode E3 is disposed nearer to the other end of the substrate-confronting surface 11*bs* of the flange 11*b* in the x-direction. The separation distance $D_{13}$ between the terminal electrodes E3 and E1 and the separation distance $D_{23}$ between the terminal electrodes E3 and E2 are longer than the separation distance $D_{12}$ between the terminal electrodes E1 and E2, respectively.

Likewise, the terminal electrode E4 is disposed nearer to one end of the substrate-confronting surface 11*cs* of the flange 11*c* in the x-direction, and the terminal electrodes E5, E6 are disposed nearer to the other end of the substrate-confronting surface 11*cs* of the flange 11*c* in the x-direction. The separation distance $D_{45}$ between the terminal electrodes E4 and E5 and the separation distance $D_{46}$ between the terminal electrodes E4 and E6 are longer than the separation distance $D_{56}$ between the terminal electrodes E5 and E6, respectively.

As described above, in the surface mount pulse transformer 10, the terminal electrode E3 is separated from the terminal electrodes E1, E2 on the surface of the flange 11*b*, and the terminal electrode E3 is separated from the terminal electrodes E5, E6 on the surface of the flange 11*c*. As a result, the size of the surface mount pulse transformer 10 can be reduced in comparison with a case where the terminal electrode E3 is interposed between the terminal electrodes E1, E2 and the terminal electrode E4 is interposed between the terminal electrodes E5, E6. That is, the increase of the size of the surface mount pulse transformer 10 can be suppressed.

Note that, in the invention, it is not essential to arrange the winding structure of the respective wires as shown in FIG. 3. For example, the position of the wire S2 of the second layer may be replaced with the position of the wire S3 thereof. In this case, when the nozzles 74*a*, 74*b* are moved to vicinity of the flange 11*b* to wind the wires S2, S3 by the automatic winder 70 (FIG. 11), the nozzles 74*a*, 74*b* are disposed adjacent to each other so that the nozzle 74*a* is disposed to the flange 11*b* side when viewed from the nozzle 74*b* in place of that the nozzles 74*a*, 74*b* are disposed adjacent to each other so that the nozzle 74*b* is disposed to the flange 11*b* side when viewed from the nozzle 74*a*. Accordingly, it is not necessary to intersect the wires S2, S3 by replacing the positions of the nozzles as shown in FIG. 11.

Although the preferable embodiment of the invention has been described above, it is needless to say that the invention is by no means restricted to the embodiment and can be embodied in various modes within the scope which does not depart from the gist of the invention.

What is claimed is:

1. A surface mount pulse transformer comprising:

a drum type core including a core and first and second flanges disposed on both ends of the core and to be installed onto a substrate;

a primary winding wire and a secondary winding wire wound around the core and provided with an intermediate tap, respectively;

first to third terminal electrodes formed on a surface of the first flange; and fourth to sixth terminal electrodes formed on a surface of the second flange, wherein the first and second terminal electrodes are connected to each of both ends of the primary winding wire, the third terminal electrode is connected to the intermediate tap of the secondary winding wire, the fourth terminal electrode is connected to the intermediate tap of the primary winding wire, and the fifth and sixth terminal electrodes are connected to each of both ends of the secondary winding wire.

2. The surface mount pulse transformer as claimed in claim 1, wherein the third terminal electrode is disposed nearer to one end or the other end of the substrate confronting surface of the first flange in a first direction vertical to a magnetic core direction in the substrate surface, and the fourth terminal electrode is disposed nearer to one end or the other end of the substrate confronting surface of the second flange in the first direction.

3. The surface mount pulse transformer as claimed in claim 2, wherein the first and second terminal electrodes are disposed nearer to one end of the substrate confronting surface of the first flange in the first direction, the third terminal electrode is disposed nearer to the other end of the substrate confronting surface of the first flange in the first direction, the fourth terminal electrode is disposed nearer to one end of the substrate confronting surface of the second flange in the first direction, and the fifth and sixth terminal electrodes are disposed nearer to the other end of the substrate confronting surface of the second flange in the first direction.

4. The surface mount pulse transformer as claimed in claim 2, wherein the separation distances between the third terminal electrode and each of the first and second terminal electrodes are longer than the separation distance between the first terminal electrode and the second terminal electrode, and the separation distances between the fourth terminal electrode and each of the fifth and sixth terminal electrodes are longer than the separation distance between the fifth terminal electrode and the sixth terminal electrode.

5. The surface mount pulse transformer as claimed in claim 1, wherein the primary winding wire is composed of a first wire connecting between the first terminal electrode and the fourth terminal electrode and a second wire connecting between the fourth terminal electrode and the second terminal electrode, the secondary winding wire is composed of a third wire connecting between the fifth terminal electrode and the third terminal electrode and a fourth wire connecting between the third terminal electrode and the sixth terminal electrode, and the winding direction of the first and fourth wires is opposite to the winding direction of the second and third wires when the winding direction from the first flange toward the second flange is viewed from the first flange.

6. A method of manufacturing a surface mount pulse transformer, the surface mount pulse transformer comprising:

a drum type core including a core and first and second flanges disposed on both ends of the core and to be installed on a substrate;

a primary winding wire and a secondary winding wire wound around the core and provided with an intermediate tap, respectively;

first to third terminal electrodes formed on a surface of the first flange; and fourth to sixth terminal electrodes formed on a surface of the second flange, wherein the first and second terminal electrodes are connected to each of both ends of the primary winding wire, the third terminal electrode is connected to the intermediate tap of the secondary winding wire, the fourth terminal electrode is connected to the intermediate tap of the primary winding wire, and the fifth and sixth terminal electrodes are connected to each of both ends of the secondary winding wire, the manufacturing method comprising:

simultaneously connecting a plus side end of the primary winding wire to the first terminal electrode and the intermediate tap of the secondary winding wire to the third terminal electrode;

simultaneously connecting the intermediate tap of the primary winding wire to the fourth terminal electrode and a minus side end of the secondary winding wire to the sixth terminal electrode;

simultaneously connecting a minus side end of the primary winding wire to the second terminal electrode and the intermediate tap of the secondary winding wire to the third terminal electrode; and simultaneously connecting the intermediate tap of the primary winding wire to the fourth terminal electrode and a plus side end of the secondary winding wire to the fifth terminal electrode.

7. An apparatus for manufacturing a surface mount pulse transformer, the surface mount pulse transformer comprising:

a drum type core including a core and first and second flanges disposed on both ends of the core and installed on a substrate;

a primary winding wire and a secondary winding wire wound around the core and provided with an intermediate tap, respectively;

first to third terminal electrodes formed on a surface of the first flange; and fourth to sixth terminal electrodes formed on a surface of the second flange, wherein the first and second terminal electrodes are connected to each of both ends of the primary winding wire the third terminal electrode is connected to the intermediate tap of the secondary winding wire, the fourth terminal electrode is connected to the intermediate tap of the primary winding wire, and the fifth and sixth terminal electrodes are connected to each of both ends of the secondary winding wire, the manufacturing apparatus simultaneously connects the plus side end of the primary winding wire to the first terminal electrode and the intermediate tap of the secondary winding wires to the third terminal electrode, simultaneously connects the intermediate tap of the primary winding wire to the fourth terminal electrode and the minus side end of the secondary winding wire to the sixth terminal electrode, simultaneously connects the minus side end of the primary winding wire to the second terminal electrode and the intermediate tap of the secondary winding wire to the third terminal electrode, and simultaneously connects the intermediate tap of the primary winding wire to the fourth terminal electrode and the plus side end of the secondary winding wire to the fifth terminal electrode.

* * * * *